US008112821B1

(12) United States Patent
Barry

(10) Patent No.: US 8,112,821 B1
(45) Date of Patent: Feb. 14, 2012

(54) SWEAT-ABSORBING LINER FOR USE WITH HEADWEAR AND ASSOCIATED METHOD

(76) Inventor: Thomas Barry, Howell, NJ (US)

( * ) Notice: Subject to any disclaimer, the term of this patent is extended or adjusted under 35 U.S.C. 154(b) by 952 days.

(21) Appl. No.: 12/151,123

(22) Filed: May 5, 2008

(51) Int. Cl.
*A42C 5/00* (2006.01)

(52) U.S. Cl. ..... 2/181

(58) Field of Classification Search ..... 2/181, 183
See application file for complete search history.

(56) References Cited

U.S. PATENT DOCUMENTS 1,986,312 A * 1/1935 Wilson ..... 2/63
4,502,156 A * 3/1985 Wishman ..... 2/181
5,566,395 A * 10/1996 Nebeker ..... 2/181

* cited by examiner

*Primary Examiner* — Katherine Moran

(57) ABSTRACT

A perspiration-absorbing apparatus includes a core member which has a curvilinear shape and is removably positioned along a posterior face of the existing headwear. The apparatus further includes a liner removably engaged directly with the core member and directly positioned along a posterior face thereof. The liner includes a layer of rubber statically juxtaposed adjacent to the perspiration-absorbing layer and extending parallel thereto. The liner is wrapped about the core member in such a manner that the rubber layer lies over an anterior face of the core member while the perspiration-absorbing layer lies over a posterior face of the core member such that the core member is intercalated between the rubber and perspiration-absorbing layers respectively.

10 Claims, 8 Drawing Sheets

SWEAT-ABSORBING LINER FOR USE WITH HEADWEAR AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to sweat-absorbent liners for headwear and, more particularly, to a disposable sweat-absorbent liner for effectively preventing sweat and debris from running into a user's eyes or staining their headwear.

2. Prior Art

In the past, it has been common to have a variety of sweatbands positioned within headwear for absorbing sweat on the forehead of an individual during sporting activities such as golf, tennis or baseball and/or outdoor activities. Typically, such sweatbands are a part of a cap, hat or sun visor. These sweatbands are usually made of a moisture absorbing material to absorb the sweat on the forehead of an individual to prevent it from rolling down the face. Unfortunately, the moisture absorbing qualities of the materials used are not always suitable for absorbing excessive amounts of sweat generated during high energy activities.

Furthermore, such sweatbands lining the lower inside portion of the headwear are also supposed to prevent the head of the user from directly contacting the material of the hat or cap. These sweatbands are rarely completely effective in preventing moisture from migrating into the material of the hat or cap itself. The headwear, unless constructed of moisture impervious materials such as solid plastic as would be true of a protective helmet, is thus likely to become rapidly stained by sweat, oil, grease and dirt and thus rendered unattractive. A stained hat or cap may thus be discarded well before the end of its useful lifetime. It is, therefore, desirable to have additional means for protecting a hat or cap from the migration of moisture and other contaminants through the sweatband into the material of the hat or cap.

U.S. Pat. No. 4,747,162 to Yanagihara discloses a perspiration absorbing pad capable of easily preventing clothes from being stained with perspiration. The pad includes a body made of a material which is thin, has softness, stretching properties and flexibility and is excellent in moisture absorbing properties, the body having sufficient dimensions to cover any portion of the clothes which is subject to a stain of perspiration, an active adhesive applied to one surface of the body, and a release paper covering the adhesive coated surface. The pad is usable as a disposable pad. Unfortunately, this prior art example does protect a user's hat from damage caused by perspiration while wearing the hat.

U.S. Pat. No. 5,826,277 to McConville discloses an improved sweat band. The sweat band includes an elastic band adapted to fit around a user's head and a length of sponge cloth intermittently attached along spaced apart locations to the elastic band. Only the ends and spaced apart segments of the strips are attached to the elastic band, therefore allowing the elastic band to stretch without being restricted by the inelastic sponge material. In the preferred embodiment, a tubular fabric wrap surrounds the elastic band and the length of sponge cloth to provide additional absorption and also to provide comfort to the user. Unfortunately, this prior art example does protect a user's hat from damage caused by perspiration while wearing the hat.

U.S. Pat. No. 5,781,932 to Brown discloses a forehead perspiration collector and discharger constructed primarily of various sizes of vinyl or rubber tubing. The larger sized tube of the device having absorption apertures rests upon the wearer's forehead for taking in perspired fluids whereby the smaller tubes direct any contained excess fluids out to the rear discharge site. An elastic cord is joined to sliding cord retainers which rides over the tubular sides of the device which serves as an adjustable enclosure for securing to a wearer's head. Unfortunately, this prior art example does protect a user's hat from damage caused by perspiration while wearing the hat.

Accordingly, a need remains for a disposable absorbent liner for headwear and the like in order to overcome the above-noted shortcomings. The present invention satisfies such a need by providing an apparatus that is convenient and easy to use, is durable yet lightweight in design, is versatile in its applications, and provides hat wearers with an effective means of protecting their skin and headwear from the sometimes detrimental effects of perspiration.

The present invention provides an effective barrier between the wearer's forehead and the eyes during critical moments at 90 degrees plus temperatures, especially when the person is unable to wipe their brow, which could result in a botched play in the game or even worse, an injury that could have been avoided while working with power equipment. Being soft and gentle, the disposable liner is extremely comfortable to wear, providing users with absorbent cushioning about the head area. As a result, bumps and rashes that result from chafing can virtually be eliminated.

Furthermore, by providing an effective barrier between the wearer's head and the hat, use of the present invention alleviates the problem of stains and soils that result from sweating. Because of this, use of the apparatus can advantageously and effectively extend the life of the garment and save the user considerable amounts of money in replacement costs.

BRIEF SUMMARY OF THE INVENTION

In view of the foregoing background, it is therefore an object of the present invention to provide an apparatus for effectively preventing sweat and debris from running into a user's eyes or staining their headwear. These and other objects, features, and advantages of the invention are provided by a disposable-sweat-absorbent liner for headwear and the like.

In a preferred embodiment of the present invention, a perspiration-absorbing apparatus conveniently includes a core member which has a curvilinear shape and is removably positioned along a posterior face of the existing headwear. Such a core member is positioned above a bill portion of the existing headwear. The core member is formed from a water-impermeable and non-corrosive material that is deformably resilient such that the core member conforms to a contour of the user head after the existing headwear is positioned on the user forehead.

The core member effectively includes a centrally disposed female member which has a cavity formed therein and is provided with open lateral ends in fluid communication with the cavity. The core member further includes first and second male members which are slidably interfitted through the open lateral ends respectively and are adjoined with each other within the cavity. Further, each of the first and second male members is independently positional within the cavity such that a longitudinal length of the core member is adapted between extended and shortened positions at either one of the lateral ends as desired by the user.

The apparatus further includes a liner removably engaged directly with the core member and directly positioned along a posterior face thereof. Such a liner advantageously includes an adhesive layer and a perspiration-absorbing layer directly coupled thereto. Such an adhesive layer is removably affixed to the core member in such a manner that the core member and the liner are maintained at a substantially stable position along the posterior face of the existing headwear. The liner has a plurality of monolithically formed rectilinear outer edges configured to form a substantially rectangular shape.

The liner further includes a layer of rubber statically juxtaposed adjacent to the perspiration-absorbing layer and extending parallel thereto. Such a rubber layer has a medial longitudinal edge conjoined with a medial longitudinal edge of the perspiration-absorbing layer. The rubber and perspiration-absorbing layers are positioned on an anterior face of the liner. The adhesive layer is conveniently positioned on a posterior face of the liner. The liner is wrapped about the core member in such a manner that the rubber layer lies over an anterior face of the core member while the perspiration-absorbing layer lies over a posterior face of the core member such that the core member is intercalated between the rubber and perspiration-absorbing layers respectively.

The rubber and perspiration-absorbing layers have coextensive respective surface areas and thicknesses for effectively assisting the core member to remain at a substantially stable position while positioned along the posterior face of the existing headwear. The liner has longitudinal and latitudinal lengths that are respectively greater than longitudinal and latitudinal lengths of the core member so that an outer perimeter of the core member is inwardly disposed adjacent to an outer perimeter of the liner.

A method for absorbing perspiration from a user forehead while wearing an existing headwear includes the steps of: providing a core member which has a curvilinear shape; providing and removably engaging a liner directly with the core member by directly positioning the liner along a posterior face of the core member, the liner including an adhesive layer, a perspiration-absorbing layer directly coupled thereto, and a plurality of monolithically formed rectilinear outer edges configured to form a substantially rectangular shape; removably positioning the core member along a posterior face of the existing headwear such that the core member is positioned above a bill portion of the existing headwear, the core member being formed from a water-impermeable and non-corrosive material that is deformably resilient; maintaining the core member and the liner at a substantially stable position along the posterior face of the existing headwear by removably affixing the adhesive layer to the core member; and conforming the core member to a contour of the user head after the existing headwear is positioned on the user forehead.

The method further includes the steps of: providing a centrally disposed female member which has a cavity formed therein and being provided with open lateral ends in fluid communication with the cavity; providing first and second male members; and adapting a longitudinal length of the core member between extended and shortened positions at either one of the lateral ends by independently and slidably interfitting the first and second male members through the open lateral ends respectively such that the first and second male members adjoin each other within the cavity.

The method further includes the steps of: providing and statically juxtaposing a layer of rubber adjacent to the perspiration-absorbing layer by extending the rubber layer parallel to the perspiration-absorbing layer; conjoining a medial longitudinal edge of the rubber layer with a medial longitudinal edge of the perspiration-absorbing layer; positioning the rubber and perspiration-absorbing layers on an anterior face of the liner; positioning the adhesive layer on a posterior face of the liner; and wrapping the liner about the core member in such a manner that the rubber layer lies over an anterior face of the core member while the perspiration-absorbing layer lies over a posterior face of the core member such that the core member is intercalated between the rubber and perspiration-absorbing layers respectively.

The method further includes the step of: maintaining surface friction between the rubber layer and the posterior face of the existing headwear by positioning the rubber layer between the posterior face of the existing headwear and the anterior face of the core member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
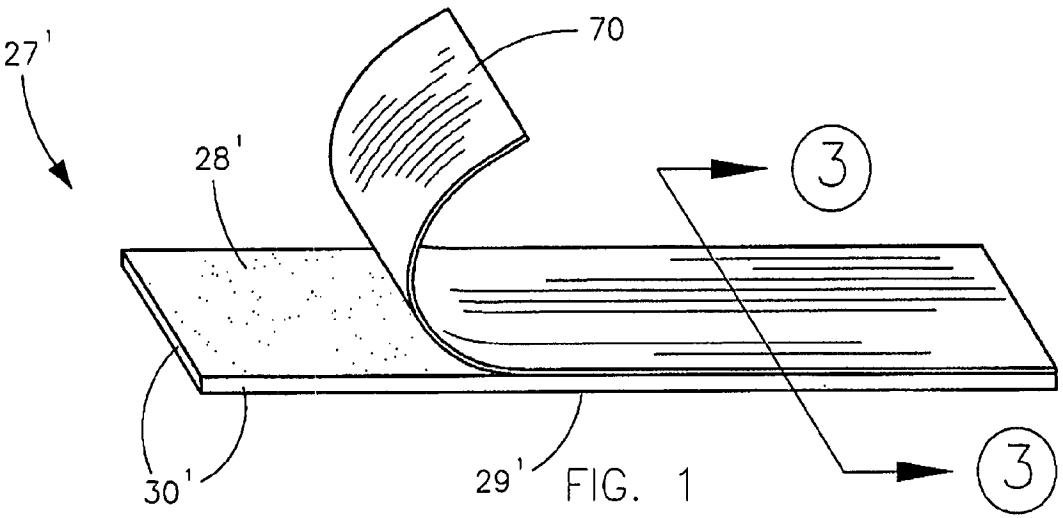
FIG. 1 is a perspective view showing an embodiment of a liner, in accordance with the present invention.
Figure 2:
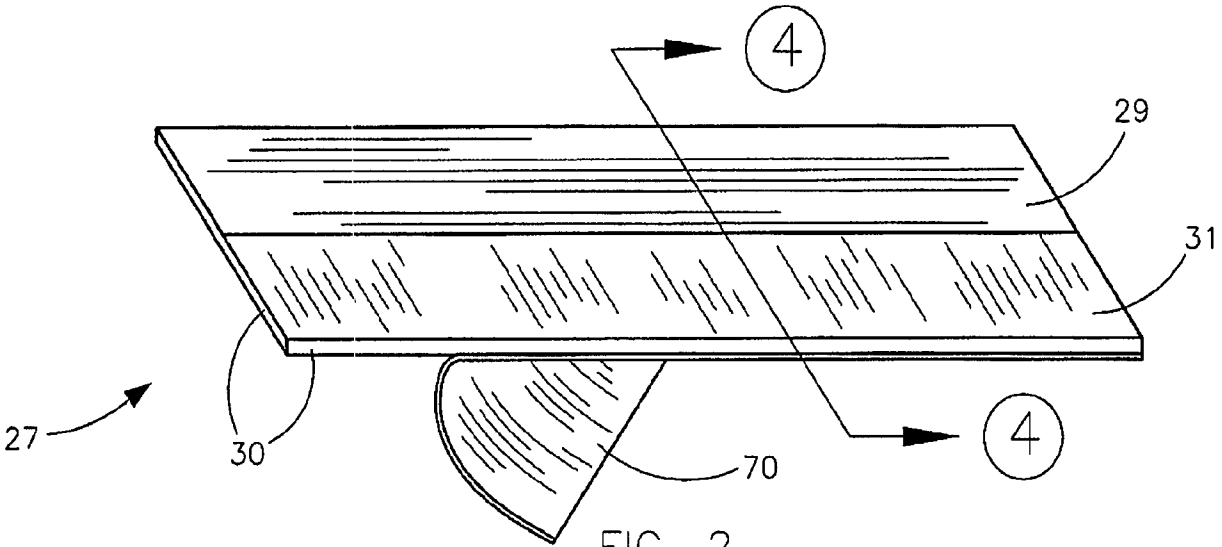
FIG. 2 is a perspective view showing another embodiment of a liner, in accordance with the present invention.
Figure 3:
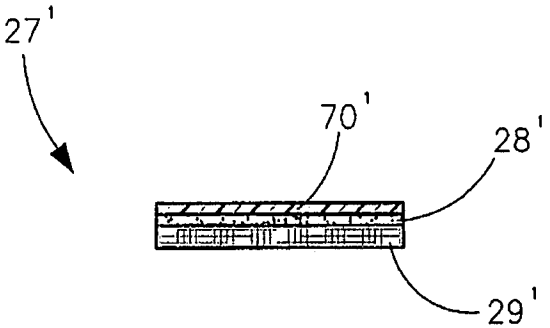
FIG. 3 is a cross sectional view of the FIG. 1 liner, taken along line 3-3.
Figure 4:
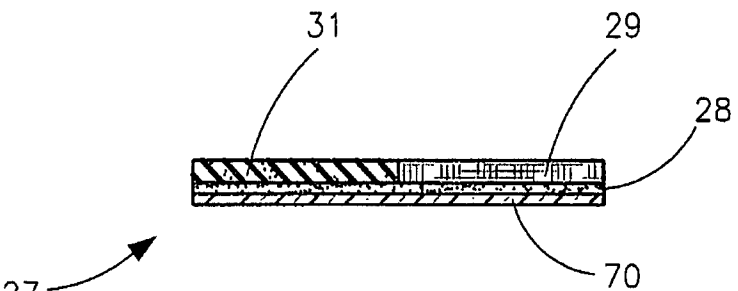
FIG. 4 is a cross sectional view of the FIG. 2 liner, taken along line 4-4.
Figure 5:
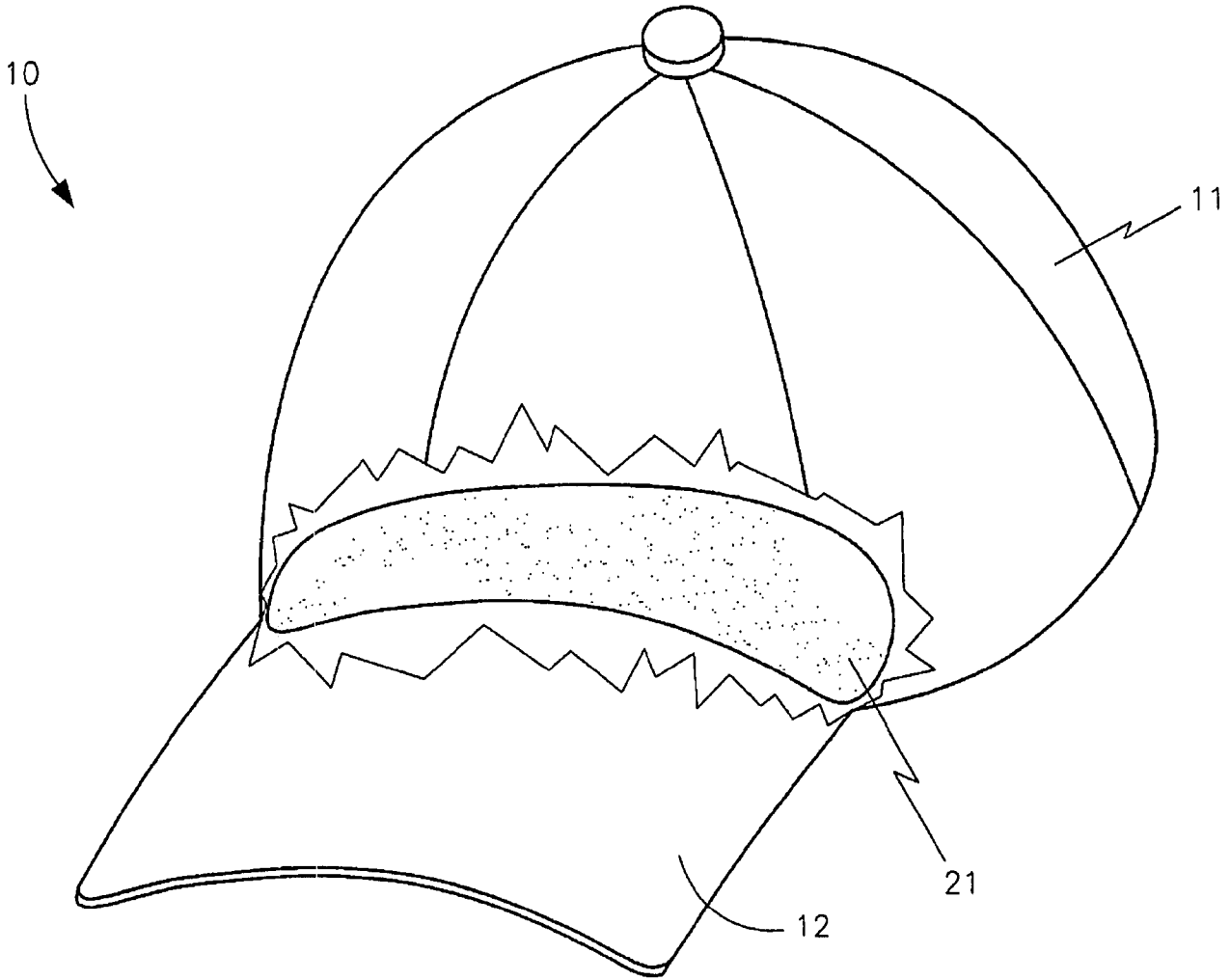
FIG. 5 is a broken view showing a front perspective of a core member in use with an existing hat.
Figure 6:
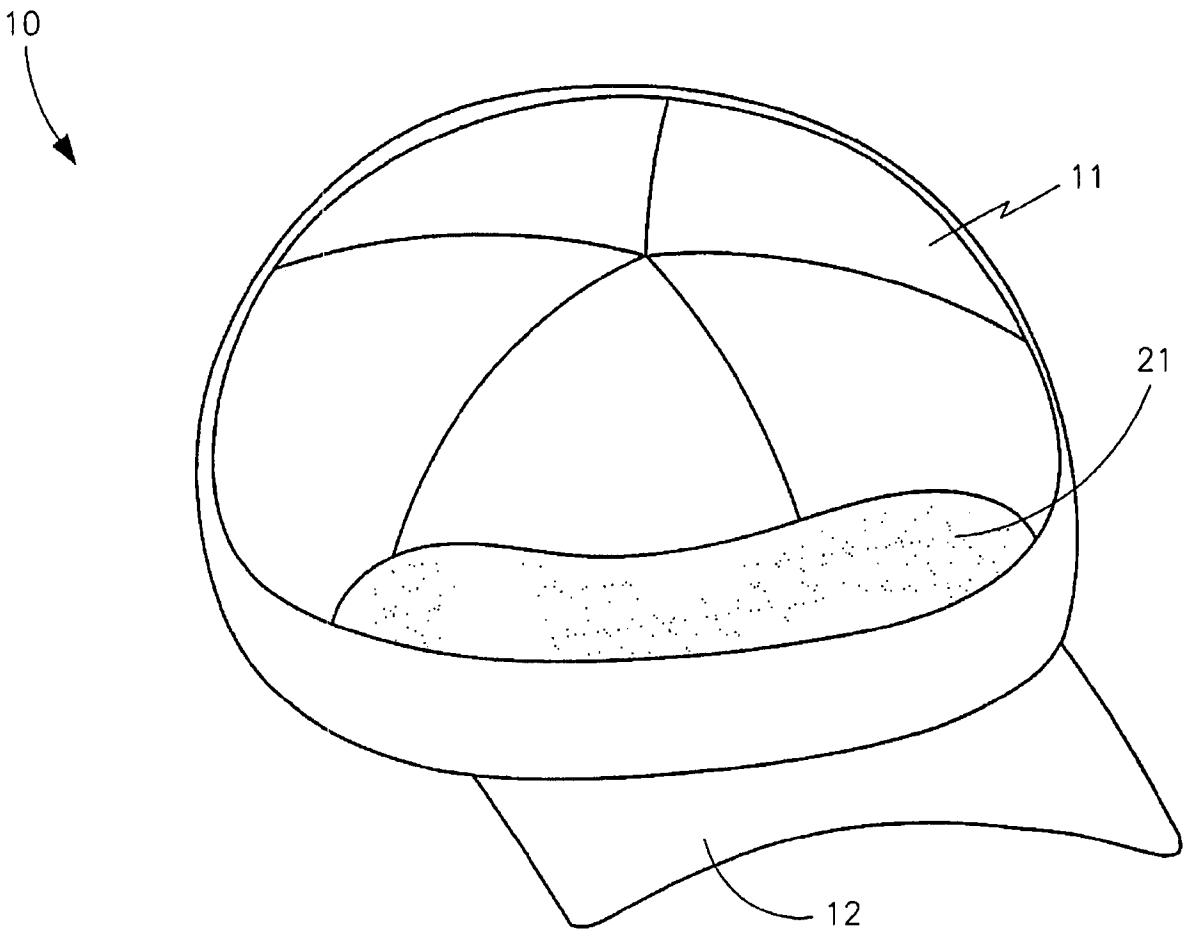
FIG. 6 is a perspective view showing an interior of the existing hat with the core member posterior on an anterior side thereof.
Figure 7:
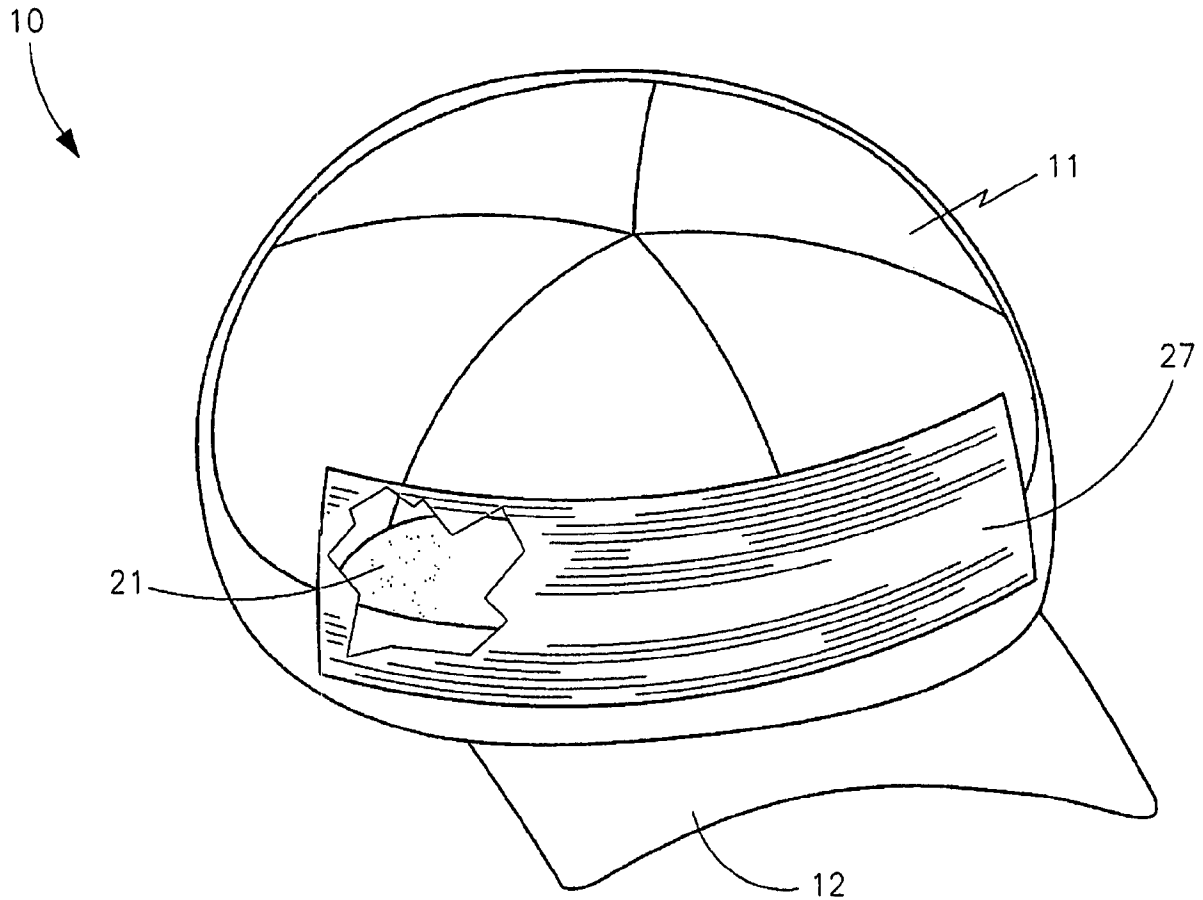
FIG. 7 is a perspective view showing an interior of the existing hat with the liner adhesively disposed over the core member.
Figure 8:
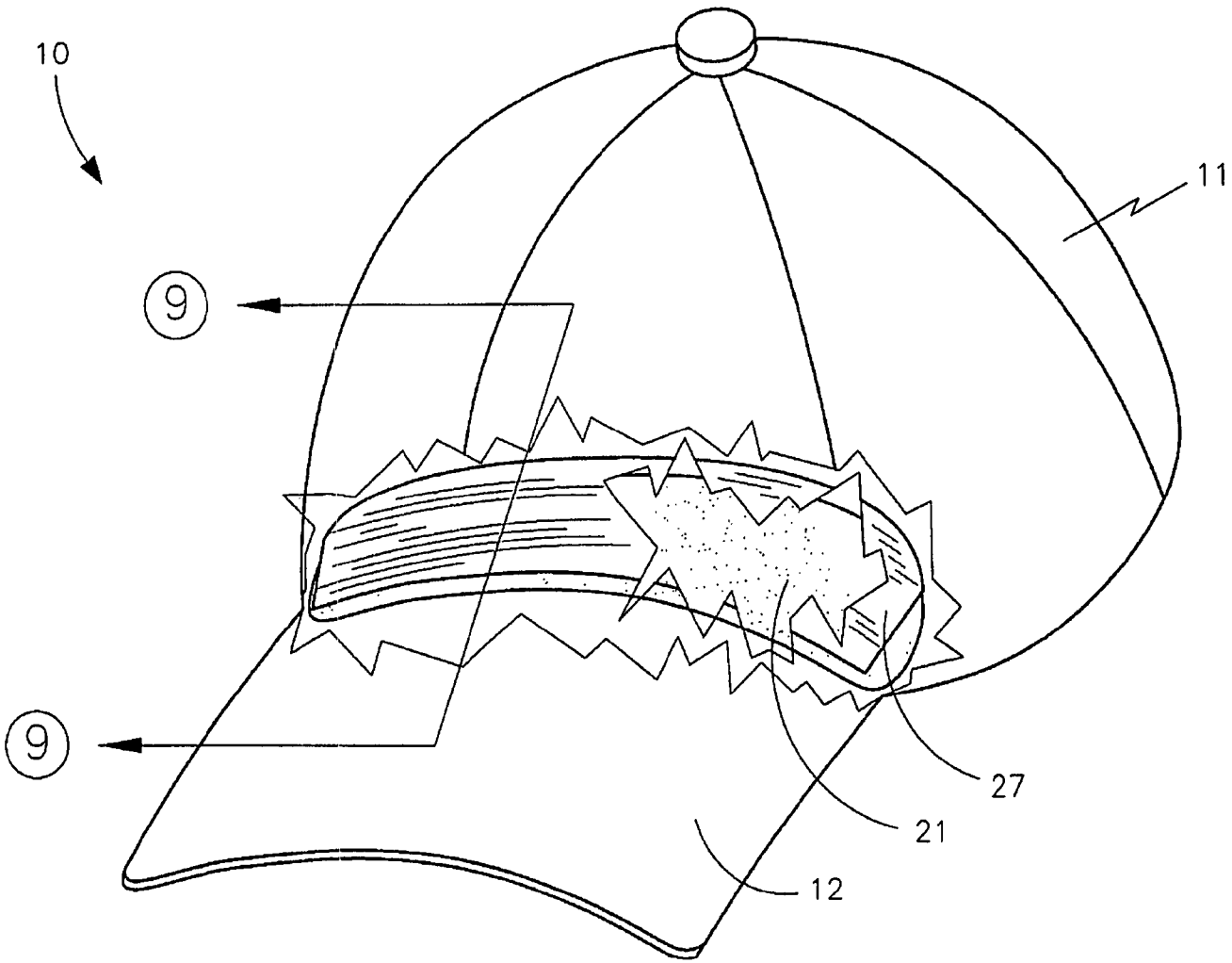
FIG. 8 is a broken view showing a front perspective of the core member with the liner adhesively attached thereto.
Figure 9:
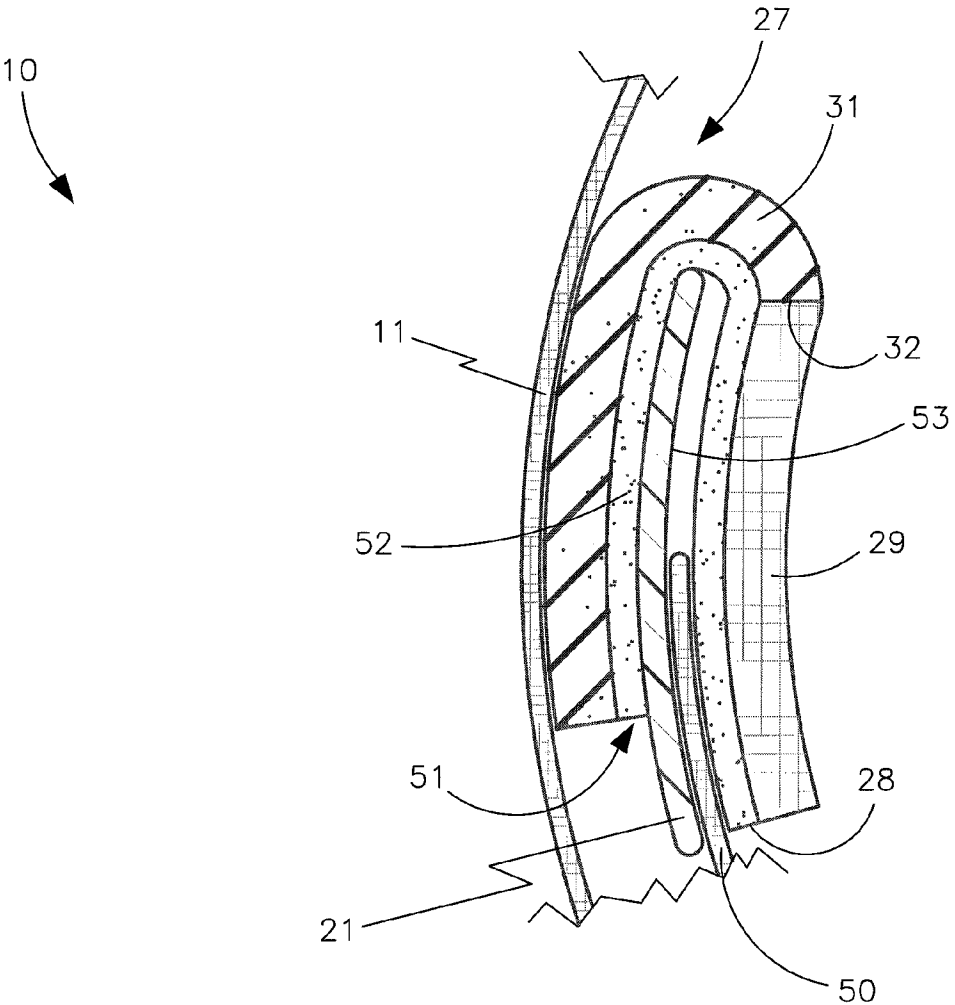
FIG. 9 is a cross sectional view of the core member and liner, taken along line 9-9, as seen in FIG. 8.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-10*b* by reference numeral 10 and is intended to provide a disposable sweat-absorbent liner for headwear and the like. It should be understood that the apparatus 10 may be used to absorb sweat along many different types of surfaces and should not be limited in use to only lining the interior surface of a baseball cap 11, for example.

Referring initially to FIGS. 5, 6, 7, and 8 a disposable sweat-absorbent liner 10 includes a core member 21 which has a curvilinear shape and is removably positioned along a posterior face of the existing headwear 11. Such a core member 21 is positioned above a bill portion 12 of the existing headwear 11 and may be suitably sized and shaped to span across a major longitudinal length of the posterior face. For example, the core member 21 preferably extends from eyebrow to eyebrow across a user's forehead but may be retrofitted to accommodate various surfaces that are prone to excreting sweat, for example. The core member 21 may be formed from a water-impermeable and non-corrosive material that is deformably resilient such that the core member 21 conforms to a contour of the user head after the existing headwear 11 is positioned on the user forehead. Suitable materials may include polyvinyl chloride, polyethylene, polymethyl methacrylate, and other acrylics, silicones, polyurethanes, etc., as well understood by one skilled in the art.

Figure 10A:
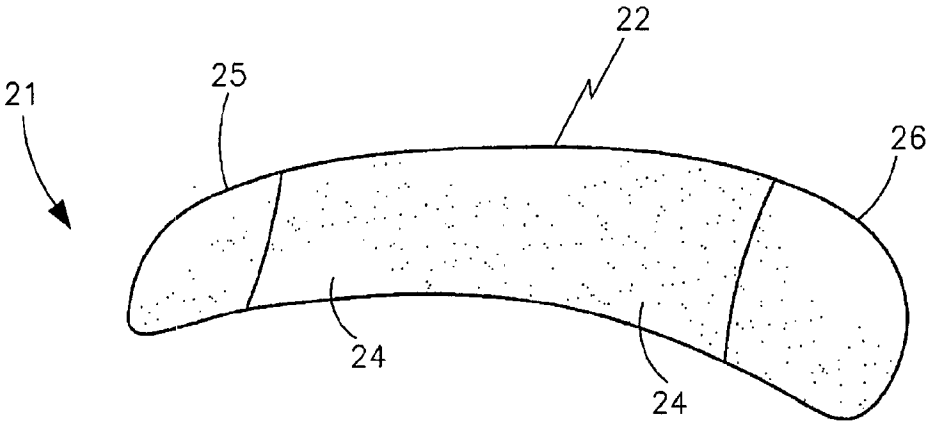
FIG. 10*a* is a perspective view showing an adjustable core member, in accordance with one embodiment of the present invention.
Figure 10B:
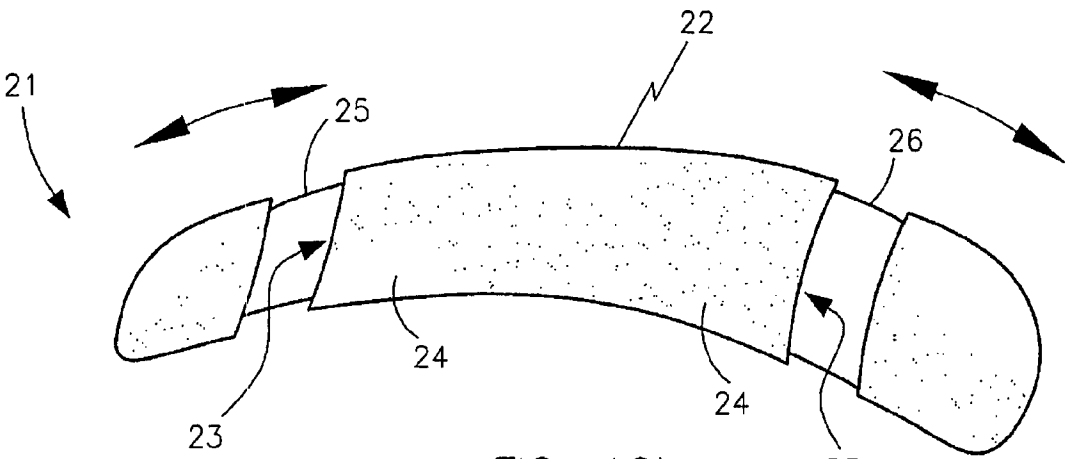
FIG. 10*b* is a perspective view showing the FIG. 10*a* core member adapted to an elongated position.

Referring to FIGS. 10, 10*a* and 10*b*, the core member 21 includes a centrally disposed female member 22 which has a cavity 23 formed therein and is provided with open lateral ends 24 in fluid communication with the cavity 23. While the cavity is not explicitly shown in the figures, one skilled in the art understands that the cavity is housed inside of the female member 22. The core member 21 further includes first and second male members 25, 26 which are slidably interfitted through the open lateral ends 24 respectively and are adjoined with each other within the cavity 23. Further, each of the first and second male members 25, 26 is independently positional within the cavity 23 such that a longitudinal length of the core member 21 is adapted between extended and shortened positions at either one of the lateral ends 24 as desired by the user. Such a combination allows a user to adjust the apparatus to make it fit within different types of headwear more comfortably. The combination of such claimed elements is not rendered obvious by one skilled in the art because it provides an unpredictable and unexpected result that overcomes shortcomings associated with a fixed-length core member 21.

Referring to FIGS. 1, 2, 3, and 4 the apparatus further includes a liner 27, 27' removably engaged directly, without the use of intervening elements, with the core member 21 and directly, without the use of intervening elements, positioned along a posterior face thereof. Such a liner 27, 27' includes an adhesive layer 28, 28' and a perspiration-absorbing layer 29, 29' directly, without the use of intervening elements, coupled thereto. Such an adhesive layer 28, 28' is removably affixed to the core member 21 in such a manner that the core member 21 and the liner 27, 27' are maintained at a substantially stable position along the posterior face of the existing headwear 11. Further, the adhesive layer is temporarily shielded by a peel-off protective layer 70, 71' that should be removed from the adhesive layer 28, 28' when a user is prepared to position the liner 27, 27' within a preexisting hat. The liner 27, 27' has a plurality of monolithically formed rectilinear outer edges 30, 30' configured to form a substantially rectangular shape.

The liner 27, 27' further includes a layer of rubber 31 statically juxtaposed adjacent to the perspiration-absorbing layer 29, 29' and extending parallel thereto. Such a rubber layer 31 has a medial longitudinal edge 32 conjoined with a medial longitudinal edge of the perspiration-absorbing layer 29, 29'. The rubber and perspiration-absorbing layers 31, 29, 29' are positioned on an anterior face 50 of the liner 27, 27'. The adhesive layer 28, 28' is positioned on a posterior face 51 of the liner 27, 27'. The liner 27, 27' is wrapped about the core member 21 in such a manner that the rubber layer 31 lies over an anterior face 52 of the core member 21 while the perspiration-absorbing layer 29, 29' lies over a posterior face 53 of the core member 21 such that the core member 21 is intercalated between the rubber and perspiration-absorbing layers respectively 31, 29, 29'. Advantageously, a ridge 50 of the hat 11 is intercalated between the core member 21 and the adhesive layer 28 for allowing the core member to slidably abut ridge 50 when a user frequently adjusts a position of the headwear during extended use and thereby tolerate shifting movements between the present invention 10 and the user's forehead, for example. Such a combination within the liner 27, 27' provides the apparatus 10 with maximum comfort while also maximizing the liners 27, 27' ability to absorb perspiration and the like.

The rubber and perspiration-absorbing layers 31, 29, 29' have coextensive respective surface areas and thicknesses for assisting the core member 21 to remain at a substantially stable position while positioned along the posterior face of the existing headwear 11. The liner 27, 27' has longitudinal and latitudinal lengths that are respectively greater than longitudinal and latitudinal lengths of the core 21 member so that an outer perimeter of the core member 21 is inwardly disposed adjacent to an outer perimeter of the liner 27, 27'. The combination of such claimed elements is not rendered obvious by one skilled in the art because it provides an unpredictable and unexpected result that solves the shortcoming of premature and undesirable movement of the core member 21 when the user adjusts the headwear over extended periods of time.

The apparatus 10 may, in one embodiment, include an absorbent liner 20 that is suitably sized and shaped for effectively adhering to the inside of a hat, baseball cap or other headwear 11. Of course, the disposable absorbent liner 20 may be produced in a variety of alternate shapes and sizes for different sweat absorption applications, as is obvious to a person of ordinary skill in the art.

Each disposable liner 20 may be produced of a soft and cottony synthetic fabric material. The disposable liner 20, in a preferred embodiment, may have a half-moon shape that effectively accommodates the unique interior curvature of hats or caps, which are essential and advantageous for ensuring no irritating bumps or folds are formed in the disposable liner 20 upon application thereof. Such a disposable liner 20 may, in a preferred embodiment, measure ten inches in length, one and one half to two and one half inches in width, and one sixteenths inches in thickness.

To conveniently facilitate easy attachment to hats, the apparatus 10 may have a durable adhesive material, centrally coated on the rear surface of each liner 20 for advantageously and effectively adhering to the plastic shield behind the front panel of a baseball cap or visor 11. Of course, the disposable liners 20 could be sold in packages containing multiple liners 20 or as single units, as is obvious to a person of ordinary skill in the art.

In use, the disposable sweat-absorbent liner 20 for headwear 11 is simple and straightforward to operate. First, the user removes the disposable liner 20 from its packaging. Turning the headwear 11 over, the user then adheres the disposable liner's 20 sticky backing around the headwear's 11 interior rim, as well as within the dome. Thus fortified with the liner 11, the headwear is ready to be donned. As the user goes about daily activities, the disposable liner 20 effectively absorbs any perspiration around the head and neck area, advantageously serving as a barrier between the skin and the headwear. After use, the disposable liner 20 may be quickly and easily peeled away from the headwear, and simply tossed in the closest garbage receptacle.

The present invention, as claimed, provides the unexpected and unpredictable benefit of an apparatus 10 that is convenient and easy to use, is durable yet lightweight in design, is versatile in its applications, and provides hat wearers with an effective means of protecting their skin and headwear from the sometimes detrimental effects of perspiration. The present invention provides an effective barrier between the wearer's forehead and the eyes during critical moments at 90 degrees plus temperatures, especially when the person is unable to wipe their brow, which could result in a botched play in the game or even worse, an injury that could have been avoided while working with power equipment.

Being soft and gentle, the disposable liner 20 is extremely comfortable to wear, providing users with sweat-absorbent cushioning about the head area. As a result, bumps and rashes that result from chafing can virtually be eliminated. Furthermore, by providing an effective barrier between the wearer's head and the headwear 11, use of the present invention alleviates the problem of stains and soils that result from sweating. Because of this, use of the apparatus 11 can advantageously and effectively extend the life of the garment and save the user considerable amounts of money in replacement costs.

In use, a method for absorbing perspiration from a user forehead while wearing an existing headwear 11 includes the steps of: providing a core member 21 which has a curvilinear shape; providing and removably engaging a liner 27, 27' directly with the core member by directly positioning the liner 27, 27' along a posterior face of the core member 21. The liner 27, 27' preferably includes an adhesive layer 28, 28', a perspiration-absorbing layer 29, 29' directly coupled thereto, and a plurality of monolithically formed rectilinear outer edges 30, 30' configured to form a substantially rectangular shape. The method may further include the step of removably positioning the core member 21 along a posterior face of the existing headwear 11 such that the core member 21 is positioned above a bill portion of the existing headwear 11. The core member 21 is preferably formed from a water-impermeable and non-corrosive material that is deformably resilient. The method may further include the steps of maintaining the core member 21 and the liner 27, 27' at a substantially stable position along the posterior face of the existing headwear 11 by removably affixing the adhesive layer 28, 28' to the core member 21; and conforming the core member 21 to a contour of the user head after the existing headwear 11 is positioned on the user forehead.

In use, the method may further include the steps of: providing a centrally disposed female member 22 which has a cavity 23 formed therein and being provided with open lateral ends 24 in fluid communication with the cavity 23; providing first and second male members 25, 26; and adapting a longitudinal length of the core member 21 between extended and shortened positions at either one of the lateral ends 24 by independently and slidably interfitting the first and second male members 25, 26 through the open lateral ends 24 respectively such that the first and second male members 25, 26 adjoin each other within the cavity 23.

In use, the method may further include the steps of providing and statically juxtaposing a layer of rubber 31 adjacent to the perspiration-absorbing layer 29, 29' by extending the rubber layer 31 parallel to the perspiration-absorbing layer 29, 29'; conjoining a medial longitudinal edge of the rubber layer 31 with a medial longitudinal edge of the perspiration-absorbing layer 29, 29'; positioning the rubber and perspiration-absorbing layers 31, 29, 29' on an anterior face of the liner 27, 27'; positioning the adhesive layer 28, 28' on a posterior face of the liner 27, 27'; and wrapping the liner 27, 27' about the core member 21 in such a manner that the rubber layer 31 lies over an anterior face of the core member 31 while the perspiration-absorbing layer 29, 29' lies over a posterior face of the core member 21 such that the core member 21 is intercalated between the rubber and perspiration-absorbing layers 31, 29, 29' respectively.

In use, the method may further include the step of: maintaining surface friction between the rubber layer 31 and the posterior face of the existing headwear 11 by positioning the rubber layer 31 between the posterior face of the existing headwear 11 and the anterior face of the core member 21. Thus, a user can effectively maintain the present invention 10 in a suitable position along the forehead during extended periods of wearing the headwear 11.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for absorbing perspiration from a user forehead while wearing an existing headwear, said perspiration-absorbing apparatus comprising:

a core member being removably positioned along a posterior face of the existing headwear, said core member further being positioned above a bill portion of the existing headwear, said core member being formed from a water-impermeable and non-corrosive material that is deformably resilient such that said core member conforms to a contour of the user head after the existing headwear is positioned on the user forehead; and a liner engaged directly with said core member and being directly positioned along a posterior face thereof, said liner including an adhesive layer and a perspiration-absorbing layer directly coupled thereto, said adhesive layer being removably affixed to said core member in such a manner that said core member and said liner are maintained at a substantially stable position along the posterior face of the existing headwear;

wherein said liner has longitudinal and latitudinal lengths that are respectively greater that longitudinal and latitudinal lengths of said core member so that an outer perimeter of said core member is inwardly disposed adjacent to an outer perimeter of said liner.

2. The perspiration-absorbing apparatus of claim 1, wherein said liner further comprises:

a layer of rubber statically juxtaposed adjacent to said perspiration-absorbing layer and extending parallel thereto, said rubber layer having a medial longitudinal edge conjoined with a medial longitudinal edge of said perspiration-absorbing layer, said rubber and perspiration-absorbing layers being positioned on an anterior face of said liner, said adhesive layer being positioned on a posterior face of said liner, said liner being wrapped about said core member in such a manner that said rubber layer is lies over an anterior face of said core member while said perspiration-absorbing layer lies over a posterior face of said core member such that said core member is intercalated between said rubber and perspiration-absorbing layers respectively.

3. The perspiration-absorbing apparatus of claim 2, wherein said rubber and perspiration-absorbing layers have coextensive respective surface areas and thicknesses for assisting said core member to remain at a substantially stable position while positioned along the posterior face of the existing headwear.

4. An apparatus for absorbing perspiration from a user forehead while wearing an existing headwear, said perspiration-absorbing apparatus comprising:

a core member having a curvilinear shape and being removably positioned along a posterior face of the existing headwear, said core member further being positioned above a bill portion of the existing headwear, said core member being formed from a water-impermeable and non-corrosive material that is deformably resilient such that said core member conforms to a contour of the user head after the existing headwear is positioned on the user forehead; and a liner removably engaged directly with said core member and being directly positioned along a posterior face thereof, said liner including an adhesive layer and a perspiration-absorbing layer directly coupled thereto, said adhesive layer being removably affixed to said core member in such a manner that said core member and said liner are maintained at a substantially stable position along the posterior face of the existing headwear, said liner having a plurality of monolithically formed rectilinear outer edges configured to form a substantially rectangular shape;

wherein said liner has longitudinal and latitudinal lengths that are respectively greater than longitudinal and latitudinal lengths of said core member so that an outer perimeter of said core member is inwardly disposed adjacent to an outer perimeter of said liner.

5. The perspiration-absorbing apparatus of claim 4, wherein said liner further comprises:

a layer of rubber statically juxtaposed adjacent to said perspiration-absorbing layer and extending parallel thereto, said rubber layer having a medial longitudinal edge conjoined with a medial longitudinal edge of said perspiration-absorbing layer, said rubber and perspiration-absorbing layers being positioned on an anterior face of said liner, said adhesive layer being positioned on a posterior face of said liner, said liner being wrapped about said core member in such a manner that said rubber layer lies over an anterior face of said core member while said perspiration-absorbing layer lies over a posterior face of said core member such that said core member is intercalated between said rubber and perspiration-absorbing layers respectively.

6. The perspiration-absorbing apparatus of claim 5, wherein said rubber and perspiration-absorbing layers have coextensive respective surface areas and thicknesses for assisting said core member to remain at a substantially stable position while positioned along the posterior face of the existing headwear.

7. A method for absorbing perspiration from a user forehead while wearing an existing headwear, said method comprising the step of:

a. providing a core member having a curvilinear shape;

b. providing and removably engaging a liner directly with said core member by directly positioning said liner along a posterior face of said core member, said liner including an adhesive layer and a perspiration-absorbing layer directly coupled thereto, said liner further including a plurality of monolithically formed rectilinear outer edges configured to form a substantially rectangular shape;

c. removably positioning said core member along a posterior face of the existing headwear such that said core member is positioned above a bill portion of the existing headwear, said core member being formed from a water-impermeable and non-corrosive material that is deformably resilient;

d. maintaining said core member and said liner at a substantially stable position along the posterior face of the existing headwear by removably affixing said adhesive layer to said core member; and e. conforming said core member to a contour of the user head after the existing headwear is positioned on the user forehead.

8. The method of claim 7, wherein step a. comprises the steps of:

providing a centrally disposed female member having a cavity formed therein and being provided with open lateral ends in fluid communication with said cavity;

providing first and second male members; and adapting a longitudinal length of said core member between extended and shortened positions at either one of said lateral ends by independently and slidably interfitting said first and second male members through said open lateral ends respectively such that said first and second male members adjoin each other within said cavity.

9. The method of claim 7, wherein step b. comprises the steps of:

providing and statically juxtaposing a layer of rubber adjacent to said perspiration-absorbing layer by extending said rubber layer parallel to said perspiration-absorbing layer;

conjoining a medial longitudinal edge of said rubber layer with a medial longitudinal edge of said perspiration-absorbing layer;

positioning said rubber and perspiration-absorbing layers on an anterior face of said liner;

positioning said adhesive layer on a posterior face of said liner; and wrapping said liner about said core member in such a manner that said rubber layer lies over an anterior face of said core member while said perspiration-absorbing layer lies over a posterior face of said core member such that said core member is intercalated between said rubber and perspiration-absorbing layers respectively.

10. The method of claim 9, further comprising the step of:

maintaining surface friction between said rubber layer and said posterior face of the existing headwear by positioning said rubber layer between the posterior face of the existing headwear and said anterior face of said core member.

* * * * *